US007093690B2

(12) United States Patent
Swann

(10) Patent No.: US 7,093,690 B2
(45) Date of Patent: Aug. 22, 2006

(54) LADDER STABILIZER

(76) Inventor: Jeffrey J. Swann, 4006 E. Blvd., #6, Los Angeles, CA (US) 90066

( * ) Notice: Subject to any disclaimer, the term of this patent is extended or adjusted under 35 U.S.C. 154(b) by 76 days.

(21) Appl. No.: 10/929,009

(22) Filed: Aug. 27, 2004

(65) Prior Publication Data

US 2006/0054398 A1 Mar. 16, 2006

(51) Int. Cl.
*E06C 1/00* (2006.01)
*E06C 7/00* (2006.01)

(52) U.S. Cl. ..... 182/172; 182/200

(58) Field of Classification Search ..... 182/170, 182/172, 200, 201, 107, 203, 214, 202, 204, 182/129

See application file for complete search history.

(56) References Cited

U.S. PATENT DOCUMENTS

| | | | | |
|---|---|---|---|---|
| 46,106 | A | | 1/1865 | Hayes |
| 69,049 | A | | 9/1867 | Turner |
| 141,126 | A | | 7/1873 | Eagon |
| 485,900 | A | | 11/1892 | Tannenberg |
| 540,643 | A | | 6/1895 | Davol |
| 657,932 | A | | 9/1900 | Gardner |
| 840,365 | A | | 1/1907 | Pease |
| 1,151,809 | A | | 7/1915 | Morgan |
| 1,157,739 | A | | 10/1915 | Tyler |
| 1,329,740 | A | | 2/1920 | Barron |
| 1,385,319 | A | | 7/1921 | Enke |
| 1,442,694 | A | * | 1/1923 | Martin ..... 182/200 |
| 2,046,516 | A | | 7/1936 | Johnson |
| 2,186,119 | A | | 1/1940 | Moean |
| 2,205,935 | A | | 6/1940 | Stenroos |
| 2,354,904 | A | | 7/1944 | Young |
| 2,650,014 | A | | 7/1953 | Harrison |
| 2,868,427 | A | | 1/1959 | Hess |
| 2,960,182 | A | | 11/1960 | Swanson |
| 2,971,602 | A | | 2/1961 | West |
| 2,997,127 | A | | 7/1961 | Wojtowicz |
| 3,012,628 | A | * | 12/1961 | Zumbaum ..... 182/172 |
| 3,025,926 | A | * | 3/1962 | Vives ..... 182/201 |
| 3,059,723 | A | | 9/1962 | Shore |
| 3,508,628 | A | * | 4/1970 | Conrad ..... 182/172 |
| 3,618,703 | A | | 11/1971 | Wilke |
| 3,878,917 | A | | 4/1975 | McBride |
| 3,908,796 | A | | 9/1975 | Hurwitz |
| 3,933,221 | A | | 1/1976 | Sorenson |
| 3,937,298 | A | | 2/1976 | Hurwitz |
| 4,147,231 | A | * | 4/1979 | Chantler et al. ..... 182/172 |
| 4,175,641 | A | | 11/1979 | Reyes |
| 4,519,477 | A | * | 5/1985 | Ralston ..... 182/107 |
| 4,576,250 | A | | 3/1986 | Marish |
| 4,607,726 | A | | 8/1986 | Davis et al. |
| 4,632,220 | A | * | 12/1986 | Murrell ..... 182/170 |

(Continued)

*Primary Examiner*—Hugh B. Thompson, II
(74) *Attorney, Agent, or Firm*—Frederic M. Douglas

(57) ABSTRACT

The present invention provides a method and apparatus for stabilizing a ladder for minimizing accidents. For example, a main bracket may be connected to a lower arm, a foot bracket may be connected to the lower arm, an upper arm may be connected to the foot bracket and a slide arm may be telescopically slidable inserted inside the upper arm. Pins may be inserted into holes within the main bracket, upper arm, lower arm, and slide arm to secure the ladder stabilizer. The main bracket may be attached to most ladders regardless of side rail thickness. The ladder stabilizer may accommodate varying surfaces, flat and uneven, with the ability to fold up against the vertical sides of the ladder in a small compact unit when not in use.

44 Claims, 11 Drawing Sheets

U.S. PATENT DOCUMENTS 4,641,729 A 2/1987 Beck et al.
4,798,262 A 1/1989 Margolies
4,872,529 A 10/1989 Viets
4,899,849 A 2/1990 Levi et al.
4,949,809 A * 8/1990 Levi et al. ..... 182/172
4,964,488 A 10/1990 Stewart
5,027,923 A 7/1991 Derome
5,086,876 A * 2/1992 Severson ..... 182/172
5,094,320 A 3/1992 Deitz et al.
5,165,501 A 11/1992 Donahey
5,226,504 A 7/1993 Bumbera
5,341,899 A 8/1994 Cassamento
5,373,913 A 12/1994 Santos
5,423,397 A 6/1995 Boughner
5,462,133 A * 10/1995 Merrill et al. ..... 182/172
5,511,632 A * 4/1996 Ermis ..... 182/172
5,551,529 A 9/1996 Molitor
5,590,739 A 1/1997 High
5,715,908 A * 2/1998 Sager ..... 182/172
5,857,544 A 1/1999 Del Sole
5,868,222 A 2/1999 Charbonneau
6,167,989 B1 1/2001 Jung
6,655,497 B1 12/2003 Weatherall
2001/0047906 A1 12/2001 Murray
2002/0056591 A1 5/2002 Hrincu
2002/0074187 A1 6/2002 Bendle et al.
2004/0011590 A1 1/2004 Quick

* cited by examiner

LADDER STABILIZER

BACKGROUND OF THE INVENTION

The present invention relates generally to a safety device for a ladder and, more particularly, to an attachment adapted to be conveniently secured to either or both sides of a ladder for supporting the ladder against slipping and falling.

Conventional ladder braces have stabilizing legs fastened to the ladder. The ladder braces are often large, unwieldy, difficult to install, complex to operate, and difficult to fold and retract when storing the ladder. The ladder braces are not effective for securing ladders from slipping or falling on uneven surfaces.

One attempt to provide a solution to the above problems is disclosed in U.S. Pat. No. 4,949,809 to Levi, et al. ("Levi"). A locking mechanism for longitudinally fixing a first and a second tubular pole appears to comprise a plurality of spaced, parallel teeth projecting radially outward from the first tubular pole for engagement with an adjacent notch on a locking ring mounted on the second tubular pole. By rotating the locking ring, teeth on the locking ring mesh with teeth on the first tubular pole to prevent longitudinal displacement between the two tubular poles. However, the meshed teeth can wear from frequent use, entailing unsafe conditions where the stabilizer no longer can lock because the teeth no longer mesh securely to prevent longitudinal movement of the tubular poles. The Levi patent does not seem to disclose a compact device to be set up for securing the ladder from lateral movement and to be stowed away when the ladder is not in use. The Levi patent also does not offer a simple mechanism for operating and adjusting the support to accommodate uneven surfaces.

U.S. Pat. No. 5,086,876 to Severson ("Severson") discloses a foot-actuated ladder brace intended for stabilizing ladders. A foot-actuated extending, locking and folding means is provided for extending a foot link from its folded position to its extended position along the ladder base for interlocking the links together, for releasing the interlocked links, and for nesting and folding the links upwardly along a side rail of the ladder. The Severson patent does not seem to disclose a structure that would prevent twisting deflection of the side rails, which could lead to a person at the top of the ladder falling because the ladder, even with the brace, would not provide sufficient support. Additionally, the foot actuation does not seem to provide secure, easily recognizable locking of the ladder brace to prevent inadvertent collapse of the folding ladder brace while a person is at the top of the ladder. For example, a passerby could accidentally kick the foot-actuated ladder brace so that the brace folds up, leading to a hazardous situation for someone on the ladder.

As can be seen, there is a need for an improved apparatus and methods for stabilizing a ladder by securely locking the ladder stabilizer in place to prevent movement in lateral, torsional, and other directions to provide safety to persons using the ladder. There also is a need for an improved apparatus and methods for securing the ladder from inadvertent movement during use and for convenient stowage when the ladder is not in use. A simple mechanism for operating and adjusting the support to accommodate uneven surfaces is also needed.

SUMMARY OF THE INVENTION

In one aspect of the present invention, a ladder stabilizer comprises a main bracket; a lower arm connected to the main bracket; a foot bracket connected to the lower arm; an upper arm connected to the foot bracket; and a slide arm slidably inserted inside the upper arm.

In another aspect of the present invention, a ladder system comprises a ladder; a main bracket connected to a side rail of the ladder; a lower arm connected to the main bracket; a foot bracket connected to the lower arm; an upper arm connected to the foot bracket; and a slide arm telescopically slidable within the upper arm.

In a further aspect of the present invention, a ladder stabilizer comprises a main bracket; a lower arm connected to the main bracket; a foot bracket connected to the lower arm; an upper arm connected to the foot bracket; a slide arm; the upper arm and the slide arm each comprising a plurality of holes for telescopic adjustment; a first pin passing through one of the plurality of holes in the upper arm and passing through one of the plurality of holes of the slide arm; and a second pin passing through a bracket hole in the main bracket and passing through a slide arm box hole in the slide arm.

In a still further aspect of the present invention, a ladder stabilizer comprises a main bracket; a lower arm connected to the main bracket; a foot bracket connected to the lower arm; an upper arm connected to the foot bracket; and a slide arm; the upper arm and the slide arm each longitudinally extensible and contractible relative to each other.

In yet another aspect of the present invention, a ladder stabilizer comprises a main bracket; a lower arm connected to the main bracket; a foot bracket connected to the lower arm; an upper arm connected to the foot bracket; a slide arm slidably inserted into the upper arm; a first pin removably inserted through an upper arm hole in the upper arm and through a slide arm hole in the slide arm; and a second pin removably inserted into a bracket hole in the main bracket and through a slide arm box hole in the slide arm.

In a still further aspect of the present invention, a method for stabilizing a ladder comprises mounting a ladder stabilizer to a side rail of the ladder; wherein the ladder stabilizer includes; a main bracket connected to the side rail of the ladder; a lower arm connected to the main bracket; a foot bracket connected to the lower arm; an upper arm connected to the foot bracket; and a slide arm inserted into the upper arm.

These and other aspects, objects, features and advantages of the present invention, are specifically set forth in, or will become apparent from, the following detailed description of an exemplary embodiment of the invention when read in conjunction with the accompanying drawings.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention is useful for stabilizing and supporting ladders of various types to improve safety. When a person ascends the rungs of a ladder, the center of gravity rises with each step. To counteract the tendency for the ladder to fall, slip, flex near a bottom portion of a side rail, or otherwise fail to adequately support a person's weight, the present invention may serve to widely spread the weight at the ladder bottom to enhance safety. The present invention may be used wherever ladders can be used, such as for construction activities, building maintenance activities, repair activities or practically anywhere where activities must be performed at heights above ground level.

Conventional ladder stabilizers lack structure to support the side rails of a ladder. When a side rail of a ladder flexes, twists, or otherwise deflects, a ladder may fall, slip, or otherwise fail when a person or object is on the ladder. The present invention uses a main bracket, adjacent and parallel to a side rail of a ladder. The main bracket restrains the ladder side rail from flexing, twisting, or otherwise deflecting. The main bracket may also serve to guide the folding, storing, and movement of the components of the ladder stabilizer.

Conventional ladder stabilizers lack a foot bracket or a curved foot plate. The present invention may comprise a foot bracket for securing the ladder, even on uneven surfaces. The curved foot plate may serve to enhance stability on uneven or slippery surfaces. To adapt to various spaces and surfaces, a portion of the ladder stabilizer may be adjusted relative to other portions of the ladder stabilizer.

Figure 1:
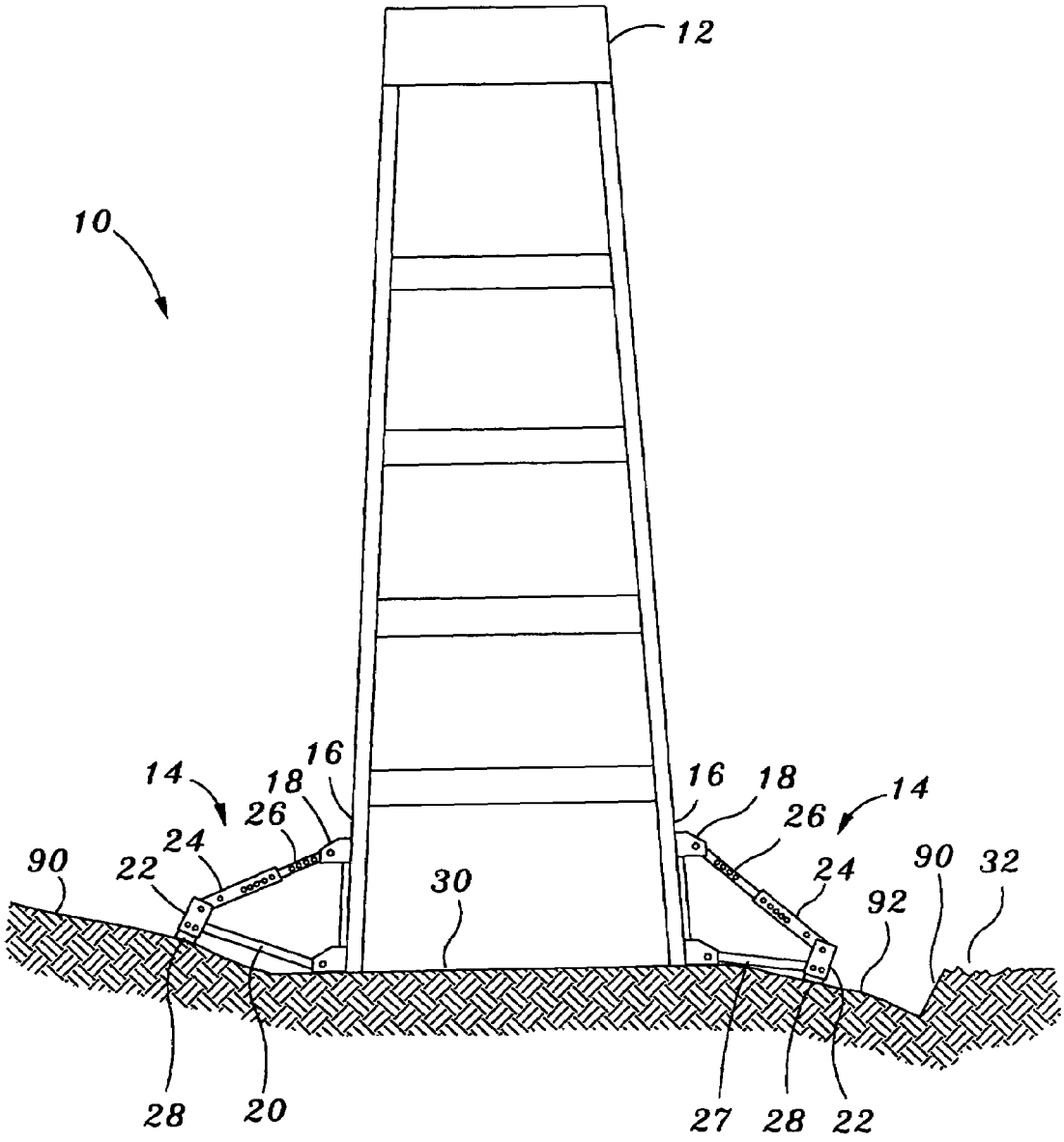
FIG. 1 is a front view of a ladder system, according to an embodiment of the present invention.

In more specifically describing the present invention, and as can be appreciated from FIG. 1, the present invention provides a ladder system 10 for safely supporting a ladder 12 when resting on a flat surface 30 or an uneven surface 32 by using a ladder stabilizer 14. The ladder stabilizer 14 may comprise a main bracket 18, which may be situated adjacent and parallel to a side rail 16 of the ladder 12. The main bracket 18 may be connected to a lower arm 20 and a slide arm 26. The slide arm 26 may be inserted, telescopically and slidably, into an upper arm 24. A foot bracket 22 may be connected to the lower arm 20 and the upper arm 24. A foot plate 28 may be connected to the foot bracket 22.

Figure 2A:
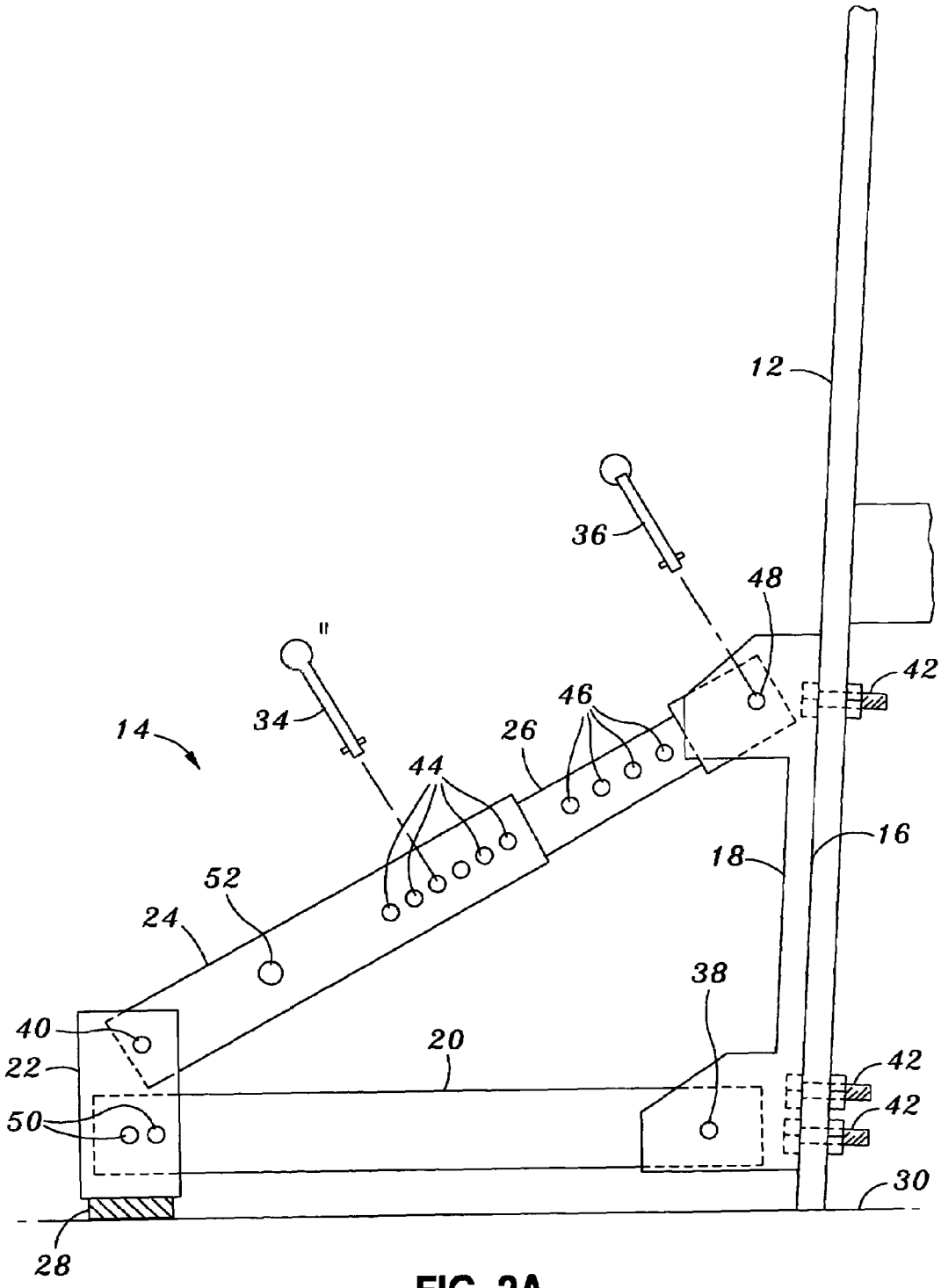
FIG. 2A is a front view of ladder stabilizer, according to an embodiment of the present invention.

As shown in FIG. 2A, the ladder stabilizer 14 may be fastened to the ladder 12 along the side rail 16 by bolts 42. A bracket hinge 38 may serve for rotating the lower arm 20 in relation to the main bracket 18. One or more foot bracket bolts 50 may be used to connect the lower arm 20 to the foot bracket 22. An arm hinge 40 may be used for rotating the upper arm 24 in relation to the foot bracket 22. A first pin 34 may be inserted through one of a plurality of upper arm holes 44, which may be aligned with one of a plurality of slide arm holes 46 for locking the slide arm 26 in place in relation to the upper arm 24. Aligning at least one of the plurality of upper arm holes 44 with at least one of the plurality of slide arm holes 46 enables using the ladder stabilizer 14 on a variety of surfaces (for example, as shown in FIG. 1, a flat surface 30, a sloping downward surface 92, a sloping upward surface 90, or an uneven surface 32). A second pin 36 may be inserted through a bracket hole 48 to lock the slide arm 26 in place in relation to the main bracket 18.

Figure 2B:
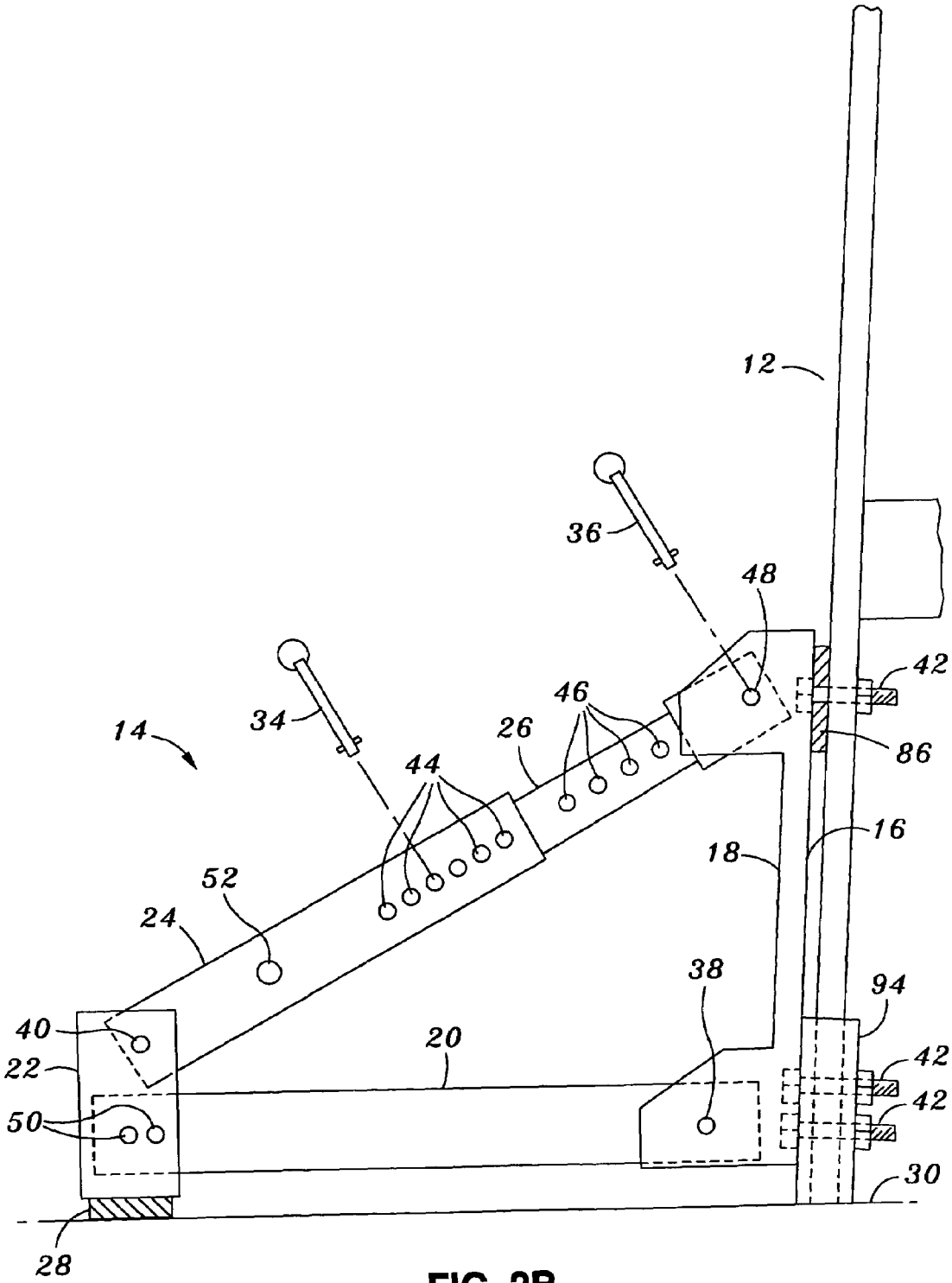
FIG. 2B is a front view of ladder stabilizer, according to another embodiment of the present invention.

Another embodiment of the present invention may be seen in FIG. 2B. The ladder stabilizer 14' may be the same as the ladder stabilizer in FIG. 2A but a partially covered ladder 12' is used. The partially covered ladder may have a side rail boot 94 that covers at least a portion of the side rail 16 of the partially covered ladder 12'. The side rail boot 94 may be made out of a sturdy, resilient material, such as vinyl, nylon, rubber, high-strength polymers, and the like. The side rail boot 94 may be used to protect the side rail 16 from slipping along surfaces. The side rail boot 94 may also serve to protect a lower portion of the side rail 16 (such as the portion near where the ladder 12' contacts a surface) from environmental damage, such as corrosion. When the side rail boot 94 is used, a top portion of main bracket 18 may not be vertically aligned evenly with a bottom portion of the main bracket 18. To keep the top portion of the main bracket 18 aligned evenly with the bottom portion of the main bracket 18, an adjustment plate 86 may be inserted between the side rail 16 and the top portion of the main bracket 18 to keep the main bracket 18 at an even distance from the side rail 16 when necessary. The adjustment plate may be made of any sturdy material, such as aluminum, steel, or high-strength plastic. With the adjustment plate 86' in place, the ladder stabilizer 14' may be securely attached to the ladder 12' with the bolts 42' that connect the main bracket 18' to the tapered side rail 16'.

Figure 2C:
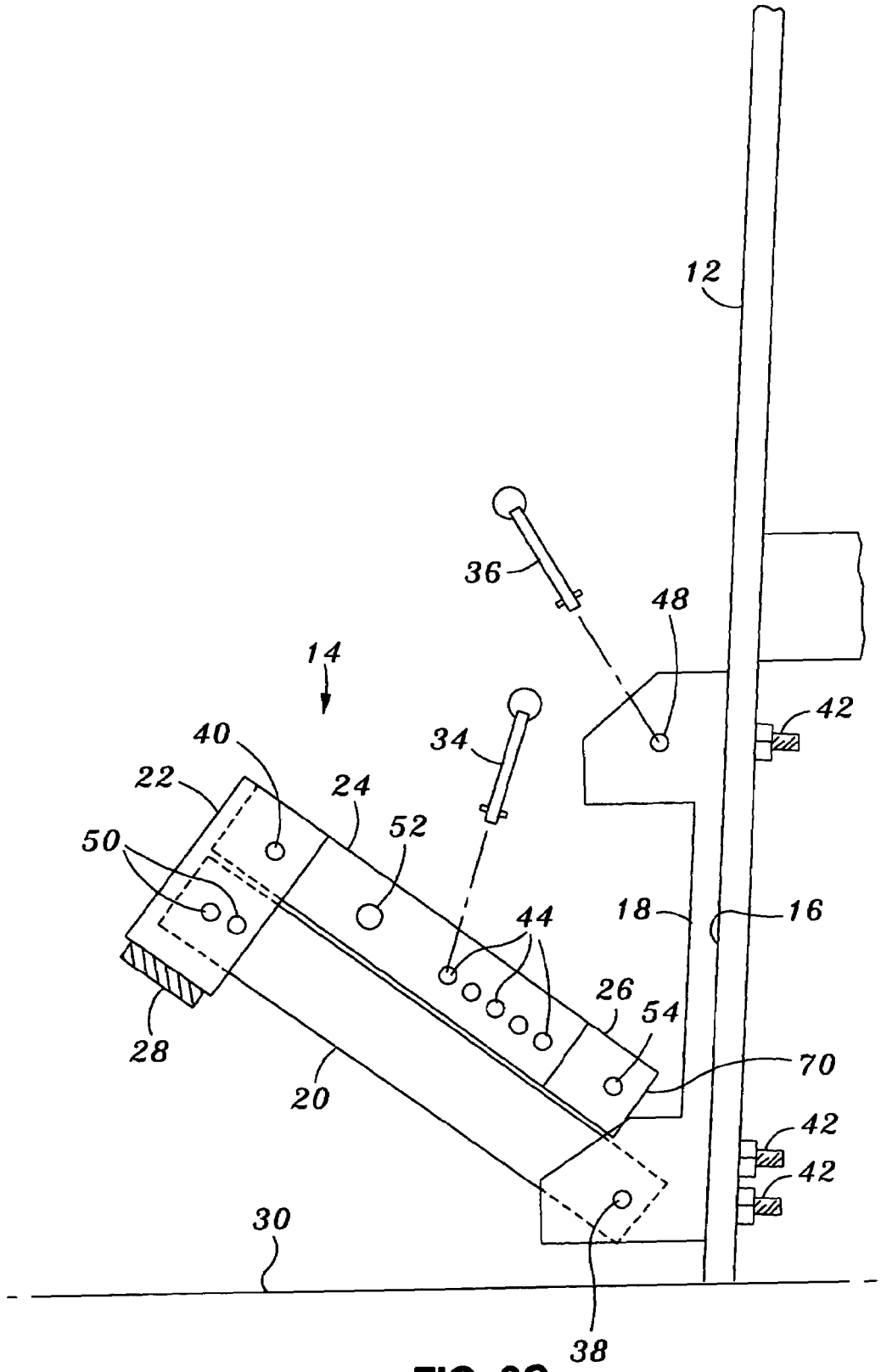
FIG. 2C is a front view of a ladder stabilizer, according to yet another embodiment of the present invention.

With reference to FIG. 2C, there is shown an initial step in storing the ladder stabilizer 14 when not in use. The second pin 36 may be removed from the bracket hole 48 and the slide arm 26 to release the slide arm from the main bracket 18. The first pin 34 may be removed from one of the plurality of upper arm holes 44 and one of the plurality of slide arm holes 46 (shown in FIGS. 2A and 2B) to allow the slide arm 26 to slide telescopically inside the upper arm 24. The slide arm 26 may be inserted into the upper arm 24 until only a slide arm box 70 may be visible from the outside of the upper arm 24. The upper arm 24 and the slide arm 26 may be rotated (along arm hinge 40) downward in relation to a surface 30. The lower arm 20 may be rotated upward, in relation to the surface 30 along the bracket hinge 38.

Figure 2D:
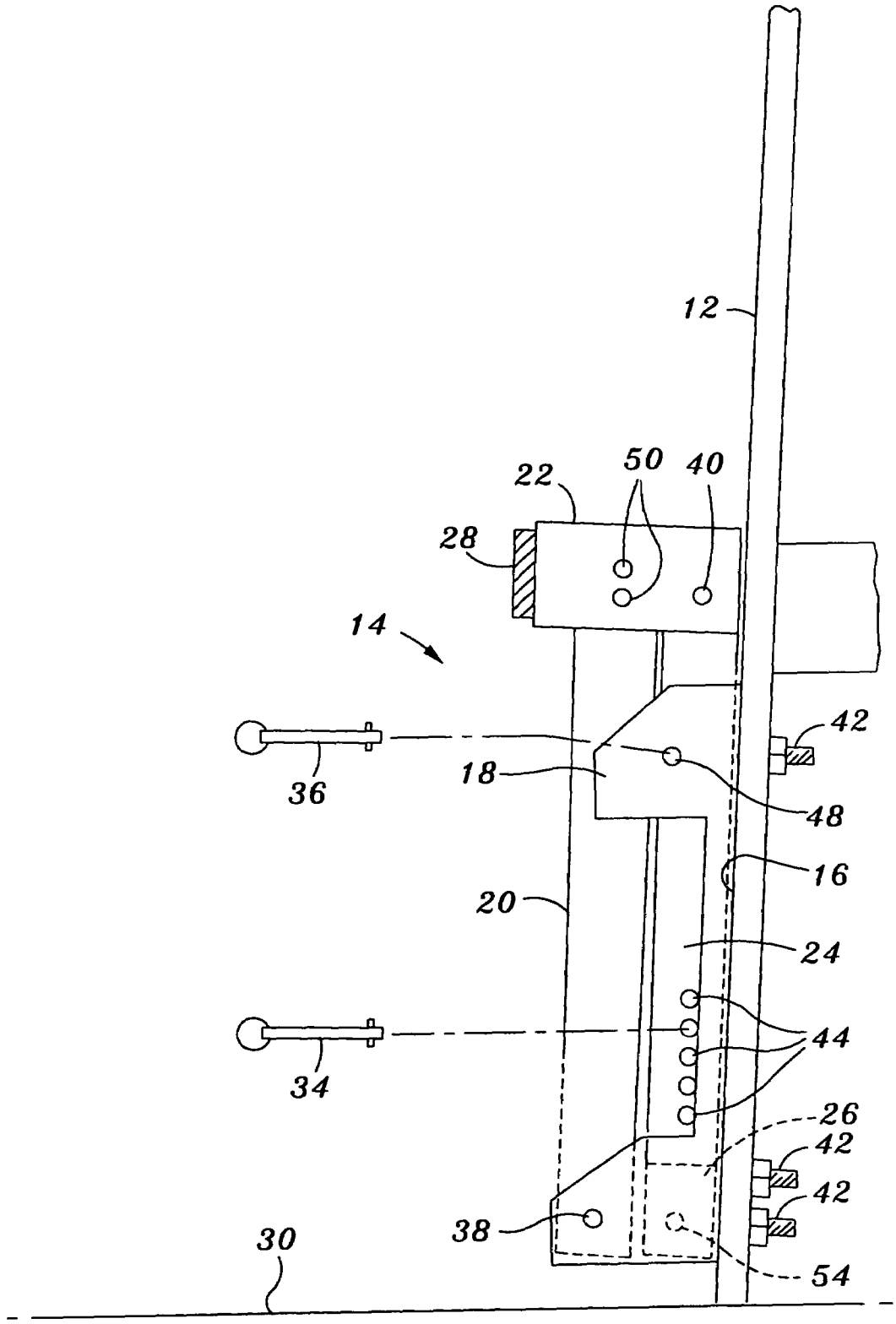
FIG. 2D is a front view of a ladder stabilizer, according to still another embodiment of the present invention.

In FIG. 2D, a next step in storing the ladder stabilizer 14 may be seen. The foot bracket 22, along with the upper arm 24, the slide arm 26, and the lower arm 20 may be rotated away from the surface 30 and toward the main bracket 18. The first pin 34 may be inserted through one of the plurality of upper arm holes 44 and one of the plurality of slide arm holes 46 (shown in FIGS. 2A and 2B). The second pin 36 may be inserted through the bracket hole 48 and an upper arm pin hole 52 (shown in FIG. 2C). In this manner, the ladder stabilizer 14 may be compactly stored when not in use.

Figure 3:
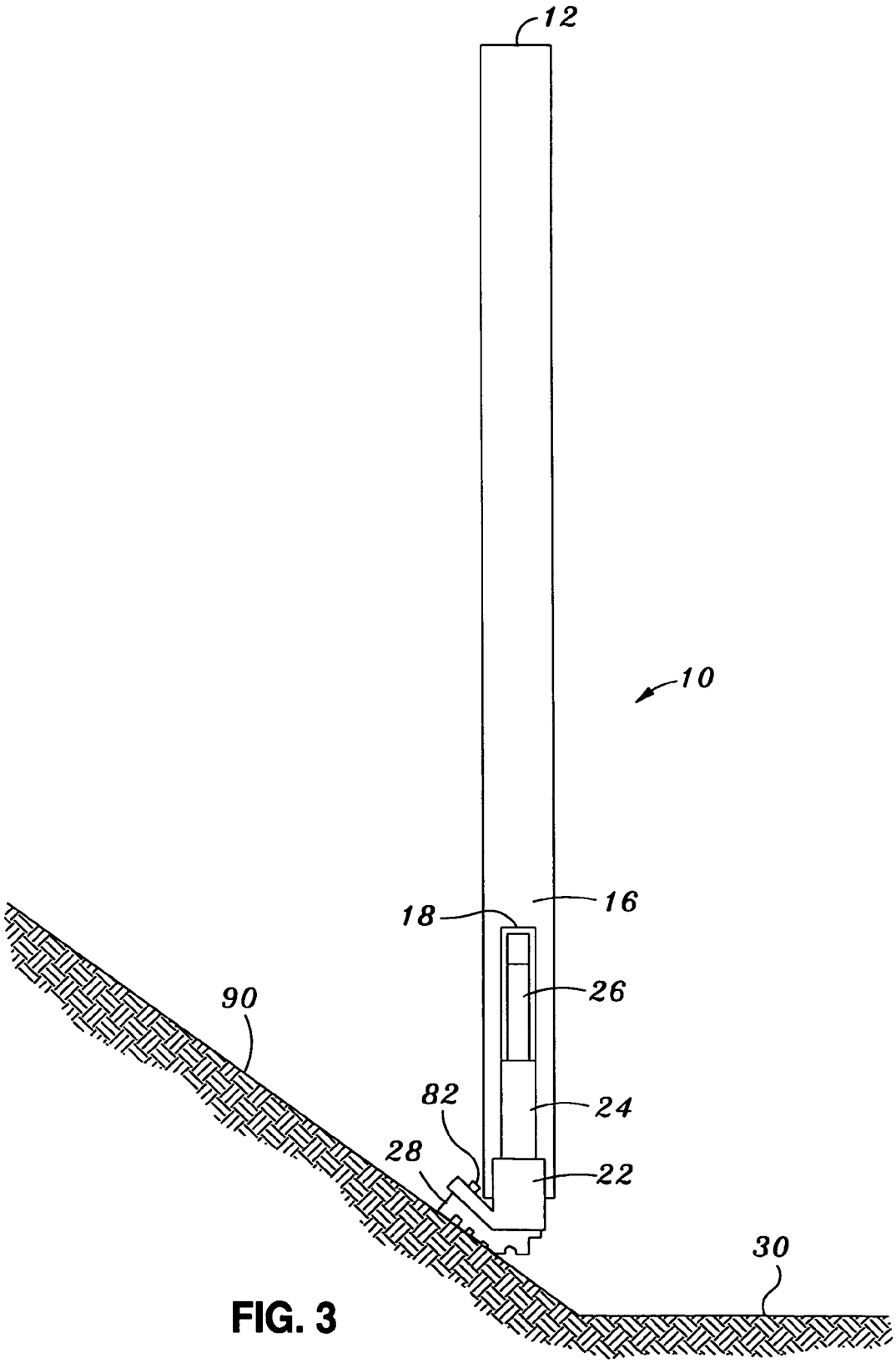
FIG. 3 is a side view of a ladder system, according to yet another embodiment of the present invention.

FIG. 3 shows a side view of a ladder system 10. The foot plate 28 may be curved in an upward direction to accommodate uneven surfaces, such as a sloping upward surface 90.

Figure 4:
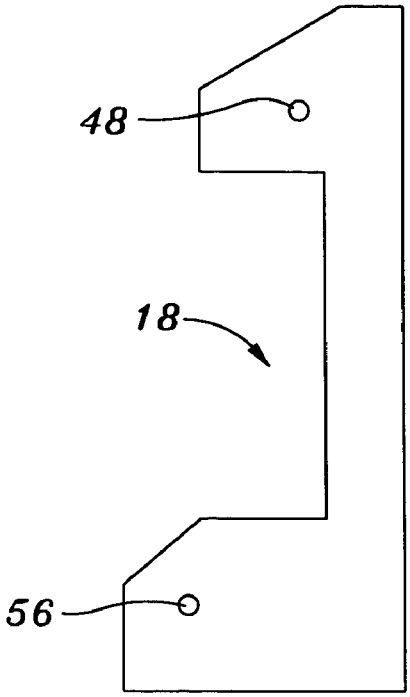
FIG. 4 is a schematic of the main bracket of FIGS. 2A and 2B.

FIG. 4 shows a front view of the main bracket 18. The main bracket 18 may be comprised of any sturdy material, such as aluminum or steel. The bracket hole 48 may be used for inserting the second pin 36 for securing the slide arm 26 when using the ladder stabilizer 14 (as shown in FIGS. 2A and 2B) or for securing the upper arm 24 with the slide arm 26 when stowing the ladder stabilizer 14 (as shown in FIG. 2D). A bracket hinge hole 56 may be used for forming the bracket hinge 38 (shown in FIG. 2D).

Figure 5:
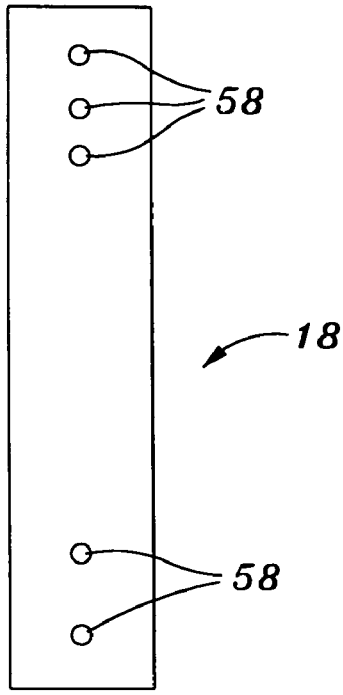
FIG. 5 is a side view of the main bracket of FIG. 4.

FIG. 5 shows a side view of the main bracket 18 with bracket holes 58 for connecting the main bracket 18 to the side rail 16 of the ladder 12 (shown in FIG. 2C).

Figure 6:
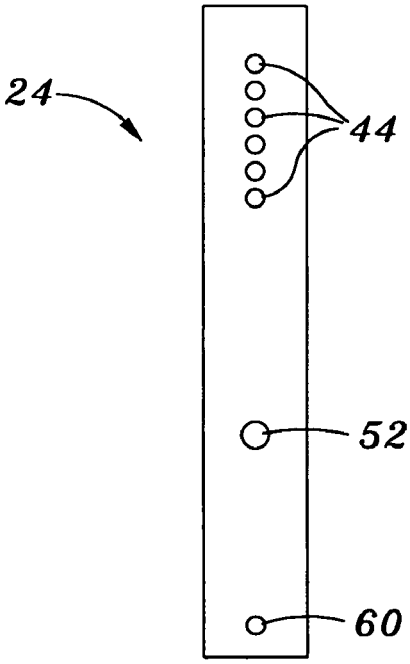
FIG. 6 is an isometric view of the upper arm of FIGS. 2A and 2B.

FIG. 6 shows the upper arm 24 of FIGS. 2A and 2B. The upper arm 24 may be made of any sturdy material, such as aluminum or steel. A plurality of upper arm holes 44 may be used for inserting the first pin 34 to secure the upper arm 24 with the slide arm 26 of the ladder stabilizer 14 (shown in FIGS. 2C and 2D). The upper arm pin hole 52 may be used for inserting the second pin 36 when storing the ladder stabilizer 14 (as shown in FIG. 2C). An arm hinge hole 60 may be used for forming the arm hinge 40 (shown in FIGS. 2A, 2B, and 2C).

Figure 7:
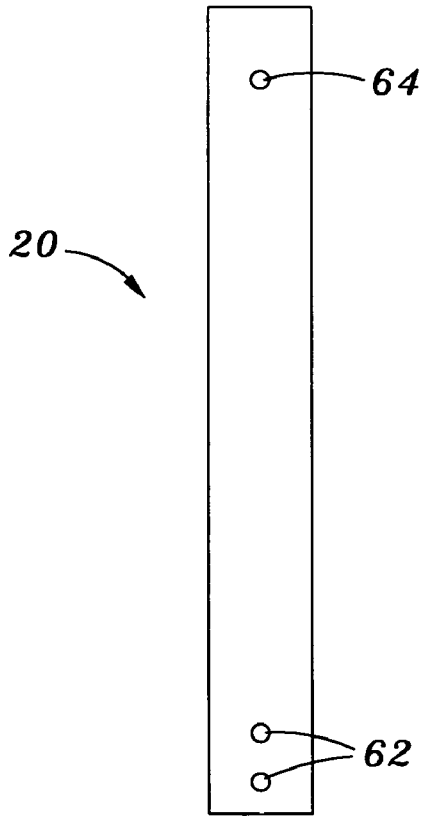
FIG. 7 is an isometric view of the lower arm of FIGS. 2A and 2B.

FIG. 7 shows the lower arm 20 of FIGS. 2A and 2B. The lower arm 20 may be made of any sturdy material, such as aluminum or steel. One or more bracket holes 62 may be used for securing the foot bracket bolts 50 (shown in FIGS. 2A, 2B, and 2C).

Figure 8:
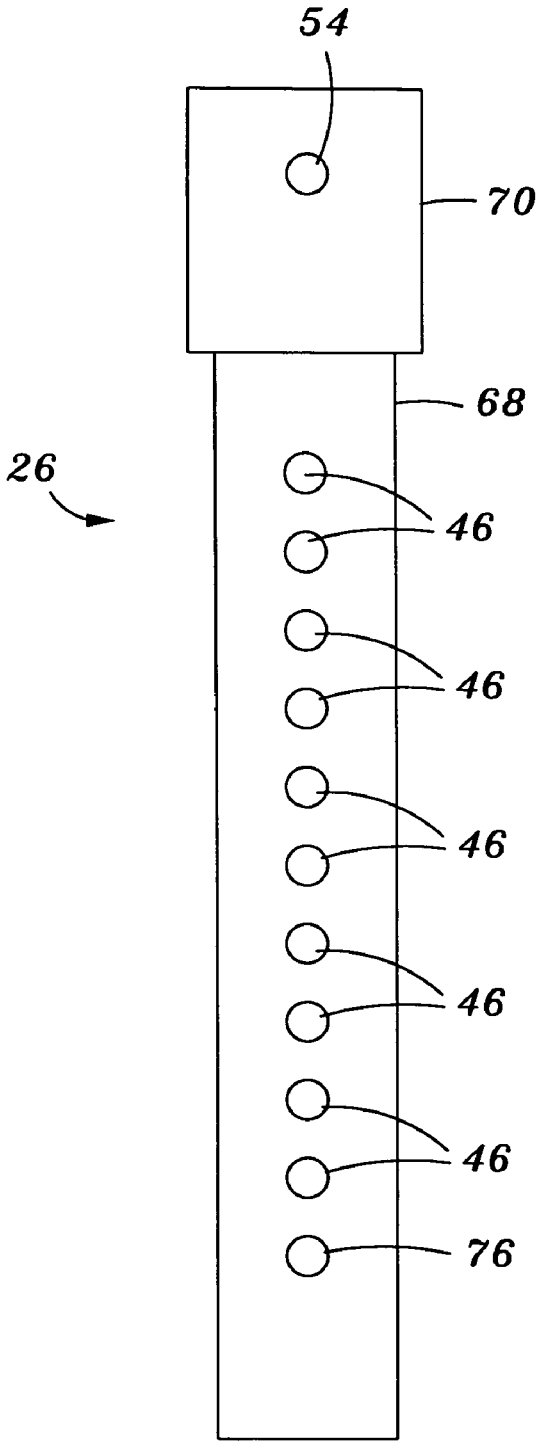
FIG. 8 is an isometric view of the slide arm of FIGS. 2A and 2B.
Figure 9:
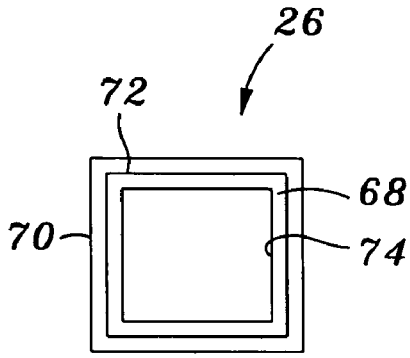
FIG. 9 is a top view of the slide arm of FIG. 8.

The slide arm 26 of FIGS. 2A and 2B is shown in FIG. 8. The slide arm 26 may be made of any sturdy material, such as aluminum or steel. A plurality of slide arm holes 46 may be used for aligning with upper arm holes 44 (shown in FIGS. 2A and 2B). Insertion of the first pin 34 through the aligned upper arm holes 44 (shown in FIGS. 2A and 2B) and through the slide arm holes 46 may secure the upper arm 24 to the slide arm 26 when setting up the ladder stabilizer 14 (shown in FIGS. 2A and 2B). A slide arm box hole 54 may be aligned with the bracket hole 48 (shown in FIGS. 2A and 2B) when setting up the ladder stabilizer 14 (shown in FIGS. 2A and 2B) for insertion of the second pin 34. FIG. 9 shows a top view of the slide arm 26 of FIG. 8. A slide arm shank 68 may be located within the slide arm box 70 such that the slide arm 26 is hollow with an inner surface 74. The slide arm box 70 may be welded to the slide arm shank 68, for example, along an interface 72 between the slide arm shank 68 and the slide arm box 70.

Figure 10:
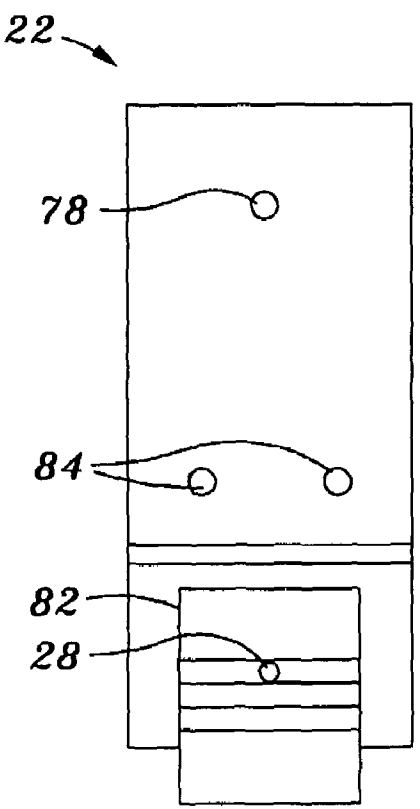
FIG. 10 is a rear view of the foot bracket of FIGS. 2A and 2B.

FIG. 10 shows a rear view of the foot bracket 22 of FIGS. 2A and 2B. The foot bracket 22 may be made of any sturdy material, such as aluminum or steel. The foot plate 28, connected to the foot bracket 22, may be comprised of rubber or another polymer. The foot plate 28 may be secured to the foot bracket 22 by a rivet 82, a screw, a bolt, or other fasteners. One or more foot bracket holes 84 may be used for inserting the foot bracket bolts 50 (shown in FIGS. 2A and 2B) to secure the foot bracket 22 to the lower arm 20 (shown in FIGS. 2A and 2B). An arm hinge hole 78 may be used for forming the arm hinge 40 (shown in FIGS. 2A and 2B) to secure the foot bracket 22 to the upper arm 24 (shown in FIGS. 2A and 2B).

Figure 11:
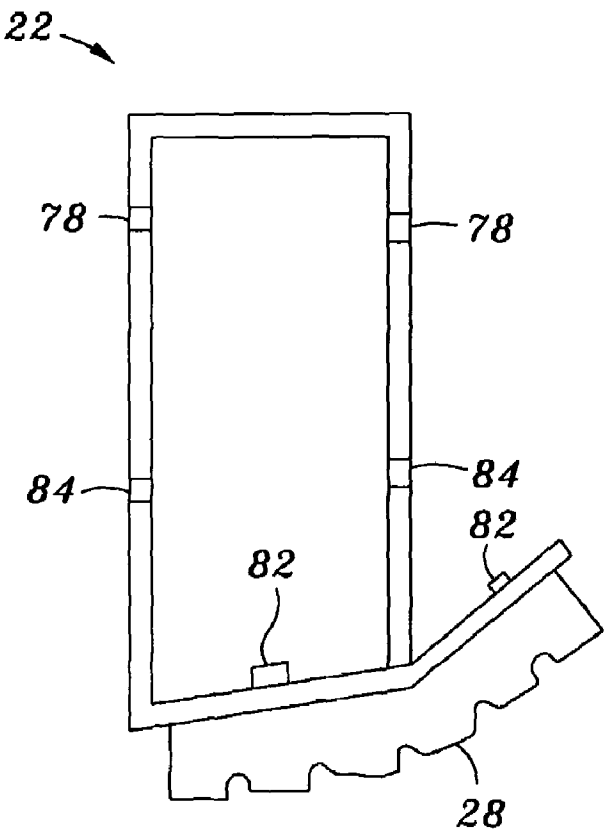
FIG. 11 is an interior view of the foot bracket of FIG. 10.

FIG. 11 shows an interior view of the foot bracket 22 of FIG. 10. As can be seen, the foot bracket 22 may be nearly hollow. The foot plate 28 may be curved in an upward direction (as shown in FIG. 11) to accommodate uneven surfaces. More than one rivet 82 may be used to secure the foot plate 28 to the foot bracket 22.

Figure 12:
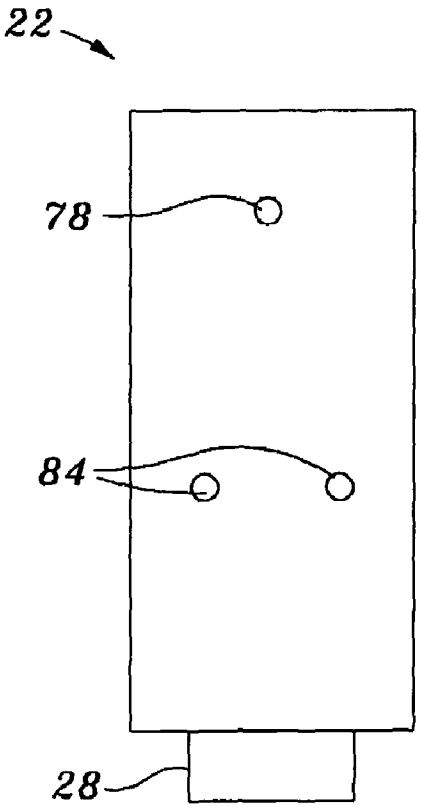
FIG. 12 is a front view of the foot bracket of FIG. 10.

FIG. 12 is a front view of the foot bracket 22 of FIG. 10.

Figure 13:
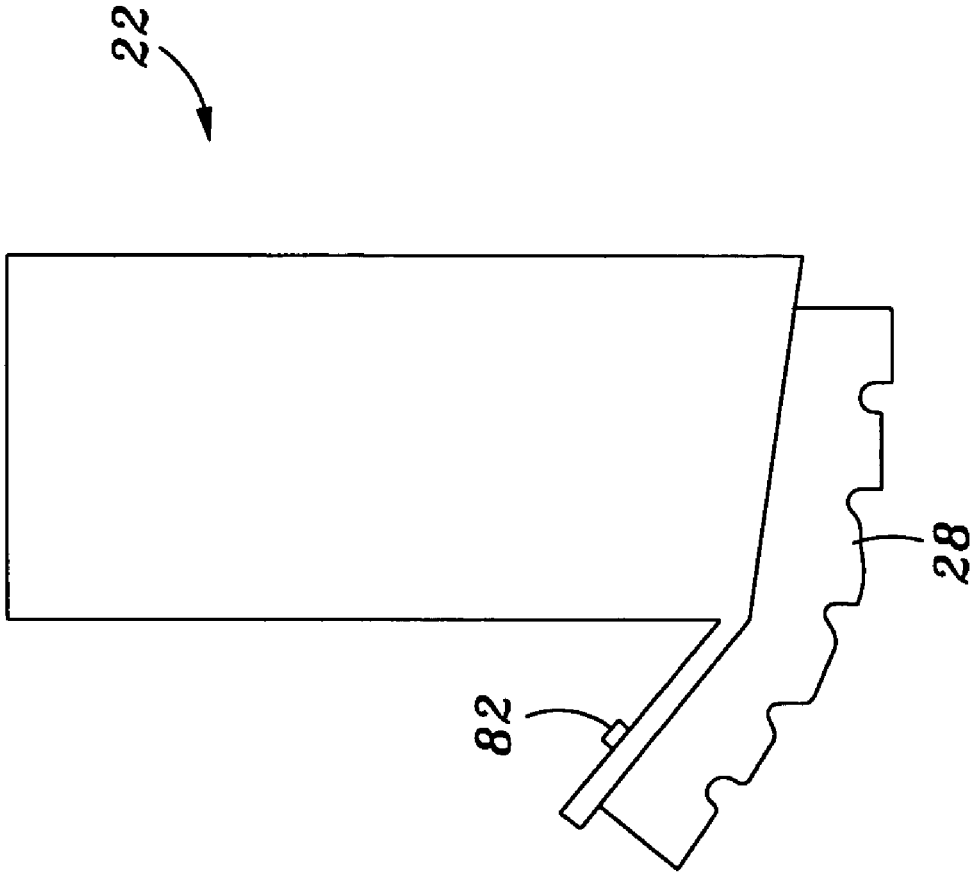
FIG. 13 is an exterior view of the foot bracket of FIG. 10.

FIG. 13 is an exterior view of the foot bracket 22 of FIG. 10.

Figure 14:
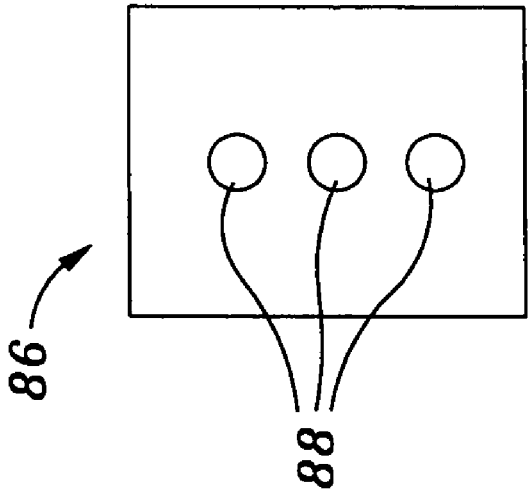
FIG. 14 is an isometric view of the adjustment plate of FIG. 2B.

FIG. 14 is an isometric view of the adjustment plate 86. Plate holes 88 may be used for insertion of at least one bolt 42 when the adjustment plate 86 is used to align the main bracket 18 and the side rail 16 (as shown in FIG. 2B).

Figure 15:
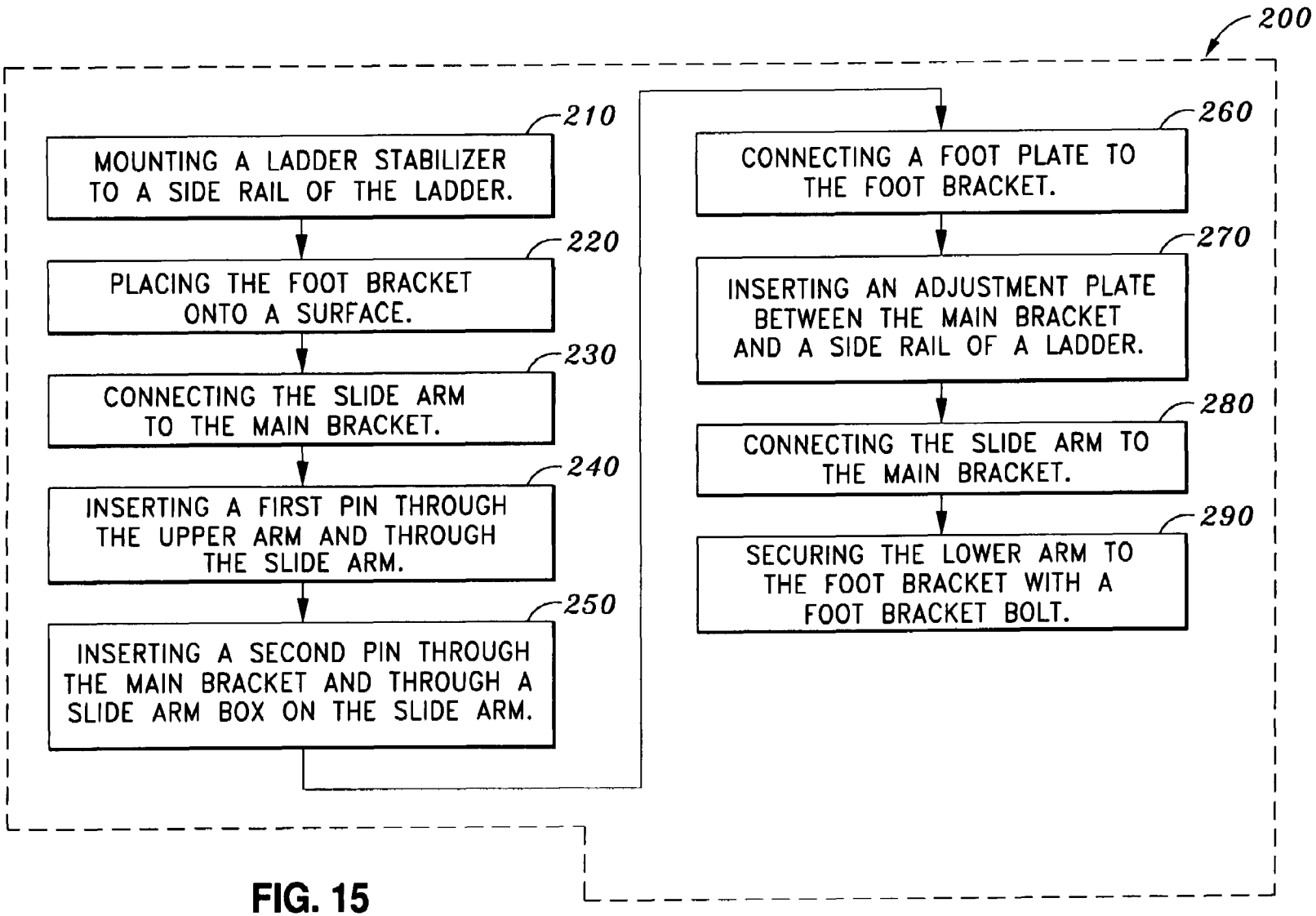
FIG. 15 is a flow diagram of a method for stabilizing a ladder, according to an embodiment of the present invention.

FIG. 15 shows a flow diagram of a method 200 for stabilizing a ladder. A step 210 may comprise mounting a ladder stabilizer to a side rail of the ladder wherein the ladder stabilizer includes a main bracket connected to the side rail of the ladder; a lower arm connected to the main bracket; a foot bracket connected to the lower arm; an upper arm connected to the foot bracket; and a slide arm inserted into the upper arm. Next, a step 220 may comprise placing the foot bracket onto a surface. Next, a step 230 may comprise connecting the slide arm to the main bracket. The method 200 may include a step 240 of inserting a first pin through the upper arm and through the slide arm. Likewise, a step 250 may include inserting a second pin through the main bracket and through a slide arm box on the slide arm. A further step 260 may comprise connecting a foot plate to the foot bracket. For tapered ladders, a step 270 may comprise inserting an adjustment plate between the main bracket and a side rail of a ladder. A step 280 may comprise connecting the slide arm to the main bracket and a step 290 may comprise securing the lower arm to the foot bracket with a foot bracket bolt.

It should be understood, of course, that the foregoing relates to exemplary embodiments of the invention and that modifications may be made without departing from the spirit and scope of the invention as set forth in the following claims.

I claim:

1. A ladder stabilizer, comprising:

a main bracket adapted to be attached to a side rail of a ladder;

a lower arm connected to the main bracket;

a foot bracket connected to the lower arm;

an upper arm connected to the foot bracket;

a slide arm slidably inserted inside the upper arm;

a first pin removably inserted through the upper arm and through the slide arm; and a second pin removably inserted through the main bracket and through a slide arm box on the slide arm.

2. The ladder stabilizer of claim 1, further comprising a foot plate connected to the foot bracket.

3. The ladder stabilizer of claim 2, wherein the foot plate is curved in an upward direction.

4. The ladder stabilizer of claim 1, further comprising a foot plate wherein the foot plate is secured to the foot bracket by a rivet.

5. The ladder stabilizer of claim 1, wherein an adjustment plate is situated between the main bracket and a side rail of a ladder.

6. The ladder stabilizer of claim 1, wherein a foot bracket bolt secures the lower arm to the foot bracket.

7. A ladder stabilizer, comprising:

a main bracket adapted to be attached to a side rail of a ladder;

a lower arm connected to the main bracket;

a foot bracket connected to the lower arm;

an upper arm connected to the foot bracket;

a slide arm;

the upper arm and the slide arm each comprising a plurality of holes for telescopic adjustment;

a first pin passing through one of the plurality of holes in the upper arm and passing through one of the plurality of holes of the slide arm; and a second pin passing through a bracket hole in the main bracket and passing through a slide arm box hole in the slide arm.

8. The ladder stabilizer of claim 7, further comprising a foot plate connected to the foot bracket.

9. The ladder stabilizer of claim of claim 7, wherein an adjustment plate is situated between the main bracket and a side rail of a ladder.

10. The ladder stabilizer of claim 7, wherein an arm hinge secures the upper arm to the foot bracket.

11. The ladder stabilizer of claim 7, wherein a foot bracket bolt secures the lower arm to the foot bracket.

12. The ladder stabilizer of claim 7, wherein a bolt secures the main bracket to a side rail of a ladder.

13. The ladder stabilizer of claim 7, wherein the slide arm is telescopically slideable within the upper arm.

14. A ladder stabilizer, comprising:

a main bracket adapted to be attached to a side rail of a ladder;

a lower arm connected to the main bracket;

a foot bracket connected to the lower arm;

an upper arm, comprising a plurality of holes for telescopic adjustment, connected to the foot bracket;

a slide arm comprising a plurality of holes for telescopic adjustment;

a first pin passing through one of the plurality of holes in the upper arm and passing through one of the plurality of holes of the slide arm; and a second pin passing through a bracket hole in the main bracket and passing through a slide arm box hole in the slide arm;

the upper arm and the slide arm each longitudinally extensible and contractible relative to each other.

15. The ladder stabilizer of claim 14, wherein the main bracket guides folding of the lower arm, the upper arm, and the slide arm.

16. The ladder stabilizer of claim 14, wherein the main bracket guides storing of the lower arm, the upper arm, and the slide arm.

17. The ladder stabilizer of claim 14, wherein the main bracket guides movement of the lower arm, the upper arm, and the slide arm.

18. The ladder stabilizer of claim 14, wherein an adjustment plate is situated between the main bracket and a side rail of a ladder.

19. The ladder stabilizer of claim 14, wherein a foot bracket bolt secures the lower arm to the foot bracket.

20. The ladder stabilizer of claim 14, wherein an arm hinge secures the upper arm to the foot bracket.

21. The ladder stabilizer of claim 14, wherein a bolt secures the main bracket to a side rail of a ladder.

22. The ladder stabilizer of claim 14, further comprising a foot plate connected to the foot bracket, wherein the foot plate is curved in an upward direction.

23. A ladder stabilizer, comprising:

a main bracket adapted to be attached to a side rail of a ladder;

a lower arm connected to the main bracket;

a foot bracket connected to the lower arm;

an upper arm connected to the foot bracket;

a slide arm slidably inserted into the upper arm;

a first pin removably inserted through an upper arm hole in the upper arm and through a slide arm hole in the slide arm; and a second pin removably inserted into a bracket hole in the main bracket and through a slide arm box hole in the slide arm.

24. The ladder stabilizer of claim 23, wherein an arm hinge secures the upper arm to the foot bracket.

25. The ladder stabilizer of claim 23, wherein a foot bracket bolt secures the lower arm to the foot bracket.

26. The ladder stabilizer of claim 23, wherein a bolt secures the main bracket to a side rail of a ladder.

27. The ladder stabilizer of claim 23, further comprising a foot plate connected to the foot bracket, wherein the foot plate is curved in an upward direction.

28. The ladder stabilizer of claim 23, further comprising a foot plate wherein the foot plate is secured to the foot bracket by a rivet.

29. The ladder stabilizer of claim 23, wherein an adjustment plate is situated between the main bracket and a side rail of a ladder.

30. A ladder system, comprising:

a ladder;

a main bracket connected to a side rail of the ladder;

a lower arm connected to the main bracket;

a foot bracket connected to the lower arm;

an upper arm connected to the foot bracket; and a slide arm telescopically slidable within the upper arm wherein an adjustment plate is situated between the main bracket and the side rail of the ladder.

31. The ladder system of claim 30, wherein the slide arm is connected to the main bracket.

32. The ladder system of claim 30, further comprising a foot plate connected to the foot bracket.

33. The ladder system of claim 32, wherein the foot plate is secured to the foot bracket by a rivet.

34. The ladder system of claim 30, wherein a foot bracket bolt secures the lower arm to the foot bracket.

35. The ladder system of claim 30, wherein the upper arm and the slide arm each comprise a plurality of holes for telescopic adjustment.

36. The ladder system of claim 35, further comprising a first pin passing through one of the plurality of holes in the upper arm and through one of the plurality of holes of the slide arm.

37. The ladder system of claim 35, further comprising a second pin passing through a bracket hole in the main bracket and passing through a slide arm box hole in the slide arm.

38. A method for stabilizing a ladder comprising:

mounting a ladder stabilizer to a side rail of the ladder;

wherein the mounting of the ladder stabilizer includes;

connecting a main bracket to the side rail of the ladder;

connecting a lower arm to the main bracket;

connecting a foot bracket to the lower arm;

connecting an upper arm to the foot bracket; and inserting a slide arm into the upper arm.

39. The method of claim 38, further comprising inserting a first pin through the upper arm and through the slide arm.

40. The method of claim 38, further comprising inserting a second pin through the main bracket and through a slide arm box on the slide arm.

41. The method of claim 38, further comprising:

inserting the slide arm telescopically into the upper arm;

rotating the slide arm and the upper arm downward in relation to a surface; and rotating the lower arm upward in relation to the surface.

42. The method of claim 41, further comprising:

rotating the slide arm, the upper arm, and the lower arm toward the main bracket.

43. The method of claim 38, the main bracket guides movement of the lower arm, the upper arm, and the slide arm.

44. The method of claim 38, further comprising securing the lower arm to the foot bracket with a foot bracket bolt.

* * * * *

UNITED STATES PATENT AND TRADEMARK OFFICE

CERTIFICATE OF CORRECTION

PATENT NO. : 7,093,690 B2
APPLICATION NO. : 10/929009
DATED : August 22, 2006
INVENTOR(S) : Jeffrey J. Swann It is certified that error appears in the above-identified patent and that said Letters Patent is hereby corrected as shown below:

Column 10, line 1, cancel the text beginning with "43. The method of claim 38" to and ending "slide arm." in Column 10, lines 2-3, and insert the following claim:

--43. The method of claim 38, wherein the main bracket guides movement of the lower arm, the upper arm, and the slide arm.--

Signed and Sealed this

Twenty-third Day of January, 2007

JON W. DUDAS
*Director of the United States Patent and Trademark Office*